US005249494A

United States Patent [19]

Borvitz

[11] Patent Number: 5,249,494

[45] Date of Patent: Oct. 5, 1993

[54] CUTTING MACHINE FOR SLICE-CUTTING, STRIP-CUTTING OR DICE-CUTTING

[75] Inventor: Wolfgang Borvitz, Braunschweig, Fed. Rep. of Germany

[73] Assignee: Herbort Maschinenbau GmbH, Braunschweig, Fed. Rep. of Germany

[21] Appl. No.: 819,124

[22] Filed: Jan. 10, 1992

[30] Foreign Application Priority Data

Jan. 12, 1991 [DE] Fed. Rep. of Germany ... 9100346[U]

[51] Int. Cl.[5] ..... B26D 3/24

[52] U.S. Cl. ..... 83/302; 83/326; 83/403; 83/404.3; 83/408

[58] Field of Search ..... 83/403, 404, 404.3, 83/408, 410.8, 411.5, 302, 321, 326, 703, 733, 788, 661, 581.1

[56] References Cited

U.S. PATENT DOCUMENTS

| | | | |
|---|---|---|---|
| 2,436,410 | 2/1948 | Urschel et al. | 83/404.3 |
| 2,934,117 | 4/1960 | Urschel et al. | 83/403 X |
| 3,010,497 | 11/1961 | Pease | 83/326 X |
| 3,857,310 | 12/1974 | Tiby | 83/403 X |
| 4,625,606 | 12/1986 | Pinegar et al. | 83/403 |

*Primary Examiner*—Eugenia Jones
*Attorney, Agent, or Firm*—Foley & Lardner

[57] ABSTRACT

The invention relates to a cutting machine for tuberiform vegetables or root crops, in which a rotor (2) is mounted rotatably in a rotation casing (1), the rotor carrying the material (4) and pressing it against the inner wall of the rotation casing. The casing is defined over a circumferential section thereof by a flap (7) mounted pivotally on the casing, with the flap when open defining a cutting gap (8) with a slice-cutting cutter (6) fixed on the casing. An adjusting device (20) is provided for pivoting the flap (7) and adjusting the thickness of the cut. A strip cutter (25), which is mounted on a driven cutting belt (10), is fitted with transversely lying cutters (12) which cut the slices (4*a*) into strips (4*b*) in a cutting zone. Downstream of the strip cutter is a dice cutter (26) which cuts the strips into dice and can comprise a circular cutter shaft or the like. The strip cutter (25) and dice cutter (26) are mounted on a common component bearer (27) fixed exchangeably on the rotation casing so as to form a compact cutting unit.

11 Claims, 3 Drawing Sheets

CUTTING MACHINE FOR SLICE-CUTTING, STRIP-CUTTING OR DICE-CUTTING

BACKGROUND AND SUMMARY OF THE INVENTION

The invention relates to a cutting machine, in particular for tuberiform vegetables or root crops, for use according to choice as a slice-cutting, strip-cutting or dice-cutting machine. The rotor is mounted rotatably in a rotation casing, and takes the material to be cut along with it in the direction of rotation and at the same time presses it against the inner wall of the rotation casing. The casing is formed over a circumferential section by a flap, which is mounted pivotally at its leading end with respect to the direction of rotation of the rotor. The rear end of the flap, in the opening position of the flap, defined with a fixedly arranged, slice-cutting cutter a cutting gap which defines the thickness of the cut. An adjusting device is provided for altering the cut by pivoting the flap, and there are further cutting devices arranged downstream of the cutting gap, outside the rotation casing.

In the prior art, it is known to arrange downstream of the rotor, as further cutting devices, a cutter shaft with circular cutters and, following this, a chopping cutter shaft or a cutter shaft with controlled flat cutters and, following this, a circular cutter shaft. In this case, the individual cutting devices, such as flat cutters, circular cutters, cutter blocks, chopping cutter blocks or the like, form separate subassemblies or machine parts, which have to be fixed separately in relation to the rotor casing in order to achieve a precise cut and ensure the function. What is disadvantageous about this in particular is that, when installing the individual cutting units, their position in relation to one another has to be exactly aligned and fixed. This arrangement is also disadvantageous with respect to the strength requirements of the components and their susceptibility to vibration. Changing the cutters is laborious and, moreover, alters the cutting dimensions, since in each case several cutting apparatuses have to be removed.

The invention is based on the object of developing a cutting machine which is easier to handle.

This object is achieved according to the invention by the cutting gap being followed downstream by a strip cutter, which is formed by a driven cutting belt, fitted with transversely lying cutters. The strip cutter cuts the slices into strips, and the strip cutter is followed downstream by a dice cutter, which cuts the strips into dice and is formed by a circular cutter shaft or the like. The strip cutter and dice cutter are combined on a common component bearer to form a compact cutting unit, which is fixed exchangeably on the rotation casing.

It is expedient if the component bearer forming the cutting unit is mounted pivotally on the rotation casing, and if the pivot axis of the component bearer runs through the axis of the upper cutting belt mounting. By such design of this pivot axis, a rapid exchange of said component bearer can be achieved. In this case, it is expedient if the dimensionally accurate seating of the component bearer on the rotation casing is ensured by fitting parts, such as for example pins or guides.

The respective cutting accuracy can be further increased by the component bearer also bearing the adjusting device for the flap, and by the component bearer also comprising the mount for the slice cutter.

The cutting belt provided according to the invention makes possible a compact cutting unit, which also comprises the dice cutter along with it. This combination has the effect of producing a dimensionally accurate position of the cutters as well as of the associated cutting apparatuses and of the associated sliding faces of the material being cut. Furthermore, fabrication is considerably simplified. Changing of the cutting unit can be carried out easily and quickly, which is advantageous in particular when changing the cutting dimensions and/or when changing cutters. If the component bearer also bears the adjusting device for the flap, whenever the unit is changed the flap is automatically pivoted into the position appropriate for the cutting dimension, so that there is no need for separate setting when altering the cutting dimensions. If the slice cutter, or the flat cutter forming it, is also seated on the component bearer, an exact cutting gap setting is also always ensured in this case.

If the component bearer can be pivoted upward, this makes the entire cutting region freely accessible.

The rotation of the rotor is preferably synchronized with the circulation of the cutting belt by means of non-slipping transmission elements. Toothed wheels, toothed belts, chains or the like may be used for this. In order to be able to pivot away, and exchange, the downstream cutting unit easily, a gear wheel stage which permits an easy releasing of the drive connection may be provided in the rotation transmission.

Due to the compact design of the downstream cutting unit, it can be installed so closely behind the cutting gap of the rotation casing that the slices of cut material leaving the cutting gap are immediately taken up by the circulating cutters of the cutting belt and, as a result, are constantly guided and transported. Due to this permanent movement control, geometric deviations can be avoided during cutting of the strips. Furthermore, the low rotational speed of the tooth-belt pulleys, or the low circulating speed of the toothed belt, is advantageous. The development of noise is greatly reduced as a result; in addition, there is little destruction of the product.

Further features of the invention are explained in more detail in conjunction with the description of the exemplary embodiments.

BRIEF DESCRIPTION OF THE DRAWINGS

A number of embodiments of the invention, serving as examples, are diagrammatically represented in the drawings, in which.

DETAILED DESCRIPTION OF THE PREFERRED EMBODIMENTS

Figure 1:
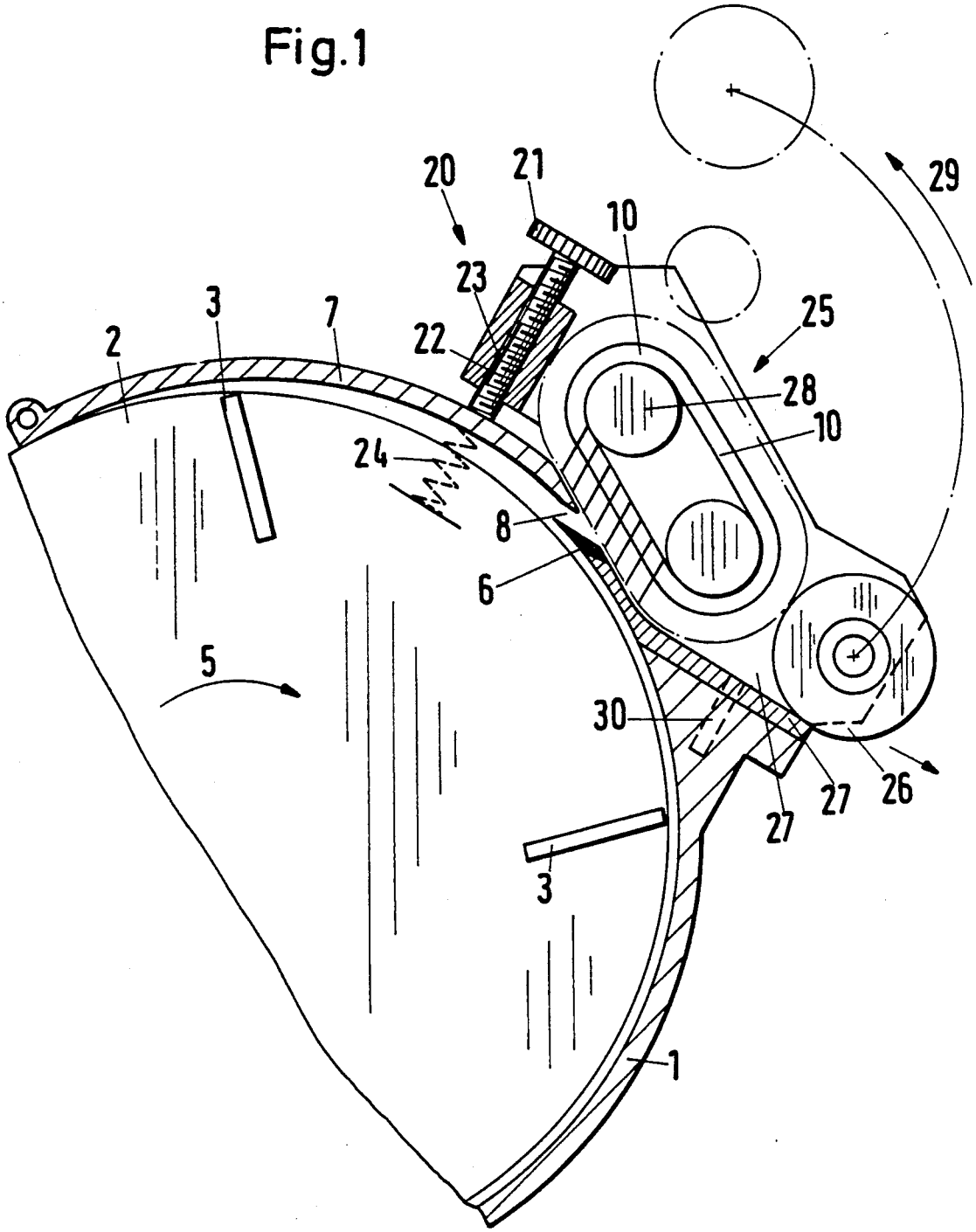
FIG. 1 is a cross-sectional view through the cutting machine comprising the invention.

Referring to FIG. 1, a rotor 2 is mounted rotatably in a rotation casing 1. The rotor is fitted with carriers 3, which take the material 4 to be cut (see FIG. 2) along with them in the direction of rotation 5 and at the same time press it against the inner wall of the rotation casing 1 and lead it against a stationary arranged flat cutter 6. The cutter cuts off a slice 4*a* (see FIG. 2) from the material 4 being cut. The rotation casing 1 is formed over a circumferential section thereof by a flap 7, which is mounted pivotally at its leading end 7a—with respect to the direction of rotation 5 of the rotor 2—and, in its open position, defines with its rear end in relation to the flat cutter 6 a cutting gap 8 which defines the thickness of the cut. An adjusting device 20 is provided for pivoting the flap 7. This adjusting device 20 comprises a threaded bolt 22 provided with a knurled screw 21 received in a sleeve fixed to the casing and having an inner thread 23. The lower end of the bolt 22 presses the flap 7 radially inwardly against the bias of a compression spring 24.

The cutting gap 8 is followed downstream by a strip cutter 25 and this is followed downstream by a dice cutter 26. Strip cutter 25 and dice cutter 26 are combined on a common component bearer 27 to form a compact cutting unit, which is mounted pivotally on the rotation casing 1. The pivoting takes place about the pivot axis 28, and the bearer 27 is movable into the opening position in the direction of arrow 29. The component bearer 27 bears both the adjusting device 20 for the flap 7 and the flat cutter 6, forming the slice cutter, with its mount. To ensure a dimensionally accurate seating of the component bearer 27 on the rotation casing 1, fitting pins 30 are provided in the exemplary embodiment represented, which pins protrude from the rotation casing 1 and, with the component bearer 27 in the working position, engage in corresponding recesses of the mount provided for the flat cutter 6.

Figure 2:
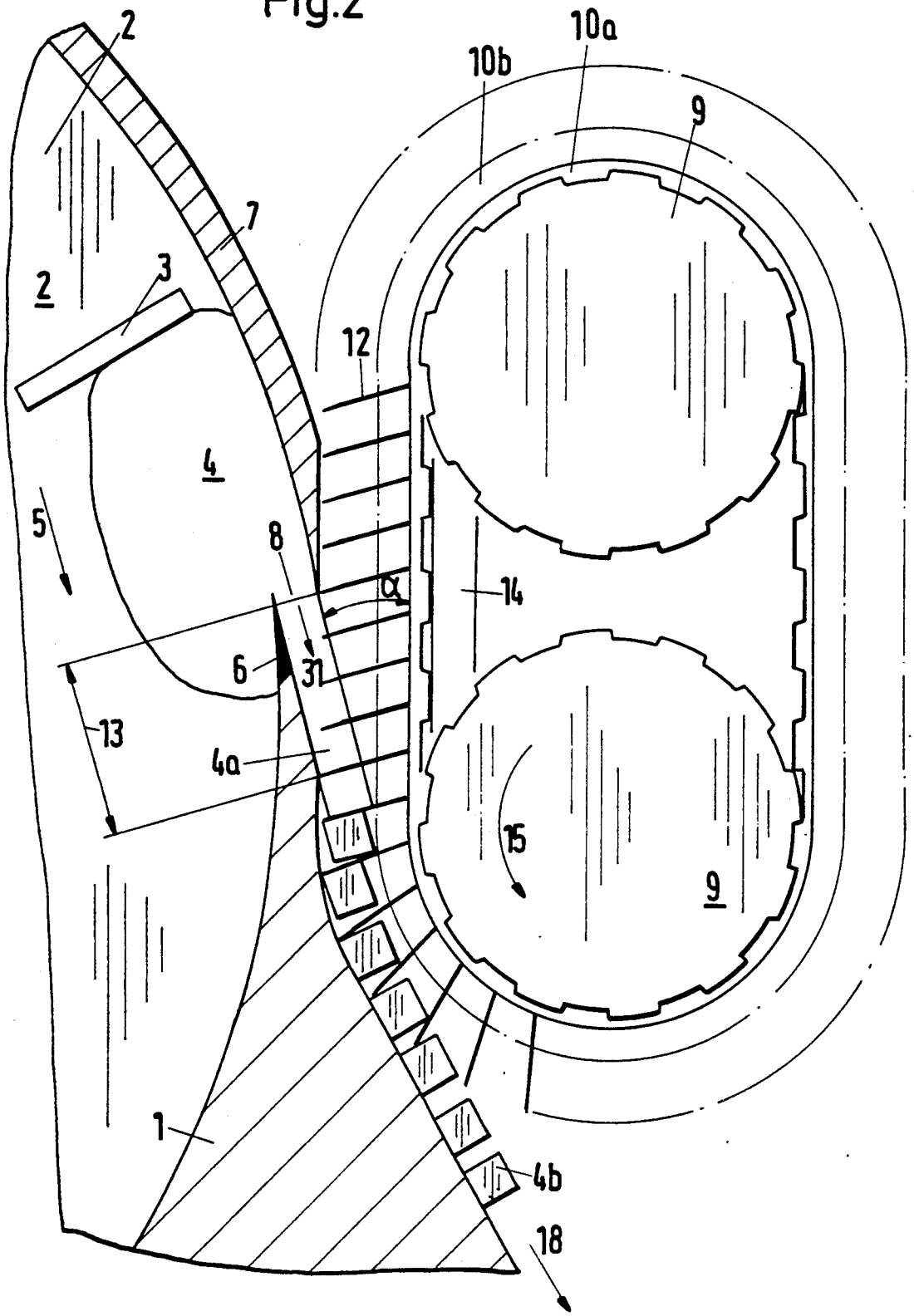
FIG. 2 is an enlarged cross-sectional view of a modified embodiment according to FIG. 1.

The strip cutter 25 comprises a cutting belt 10, which, referring to FIG. 2, is led around two toothed-belt pulleys 9 and is fitted with transversely lying cutters 12. The pivot axis 28 of the component bearer 27 is in line with the axis of rotation of the upper toothed-belt pulley 9.

The cutting zone 13 of the strip cutter 25 begins immediately after the cutting gap 8, as FIG. 2 reveals. The cutting belt 10 forms an acute angle with the advancing direction 31 of the slice 4a of cut material leaving the cutting gap 8. This angle is chosen such that, in the cutting zone 13, the cutting edges 11 (FIG. 4) of the cutters of the cutting belt 10 are at least approximately perpendicularly upright on the cutting face of the slice cutter, designed as a flat cutter 6. The driving of the rotor 2 and of the cutting belt 10 is chosen in such a way that the slices 4a of cut material leaving the cutting gap 8 have approximately the same advancing rate as the cutters 12 of the cutting belt 10 passing the cutting zone 13.

Of the downstream cutting devices, FIG. 2 shows only the strip cutter 25, in which a supporting table 14, supporting the cutting belt 10 and absorbing the cutting forces, is provided in the region of the cutting zone 13. FIG. 2 also reveals that, by altering the angle, the number of cutters 12 in the cutting zone 13 simultaneously penetrating into the slice 4a of material being cut can be varied. These cutters 12 divide each slice 4a leaving the cutting gap 8 into strips 4b, the width of which corresponds to the distance between two adjacent cutters 12. By altering the cutter spacing on the cutting belt 10, different widths of cut can be achieved. As the cutting belt 10 continues to rotate, the intermediate spaces between the cutters 12 open and release the strips 4b, which then leave the region of the cutting belt 10 under the effect of centrifugal force and are fed in the direction of the arrow 18 to a further cutting operation. According to FIG. 1, this is executed by the dice cutter 26, which is preferably designed as a circular cutter shaft, which divides up the strips 4b coming from the strip cutter 25 into dice.

The rotation of the rotor 2 is synchronized with the rotation of the cutting belt 10 and the rotation of the circular cutter shaft or of the dice cutter 26 by means of non-slipping transmission elements. In this case, a separate driving element, not shown in the drawings, may be provided between cutting belt 10 and circular cutter shaft 26.

Figure 3:
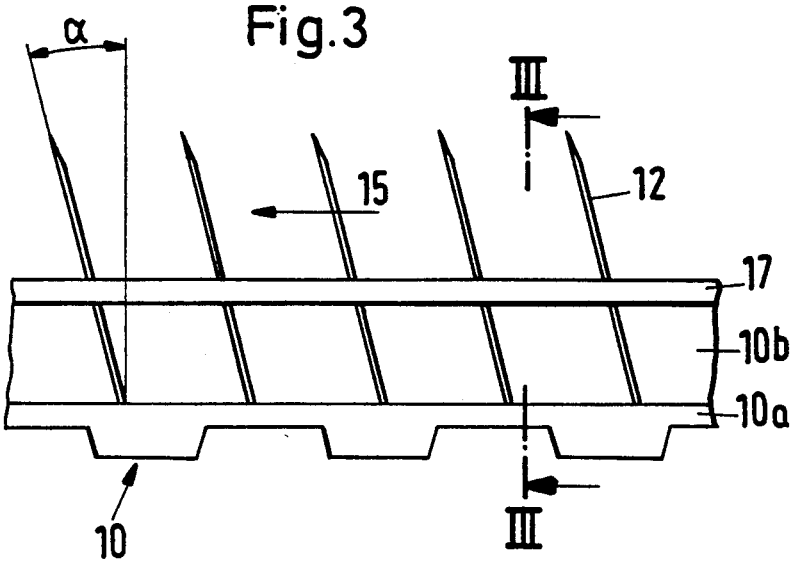
FIG. 3 is an enlarged cross-sectional fragmentary view of the cutting belt.
Figure 4:
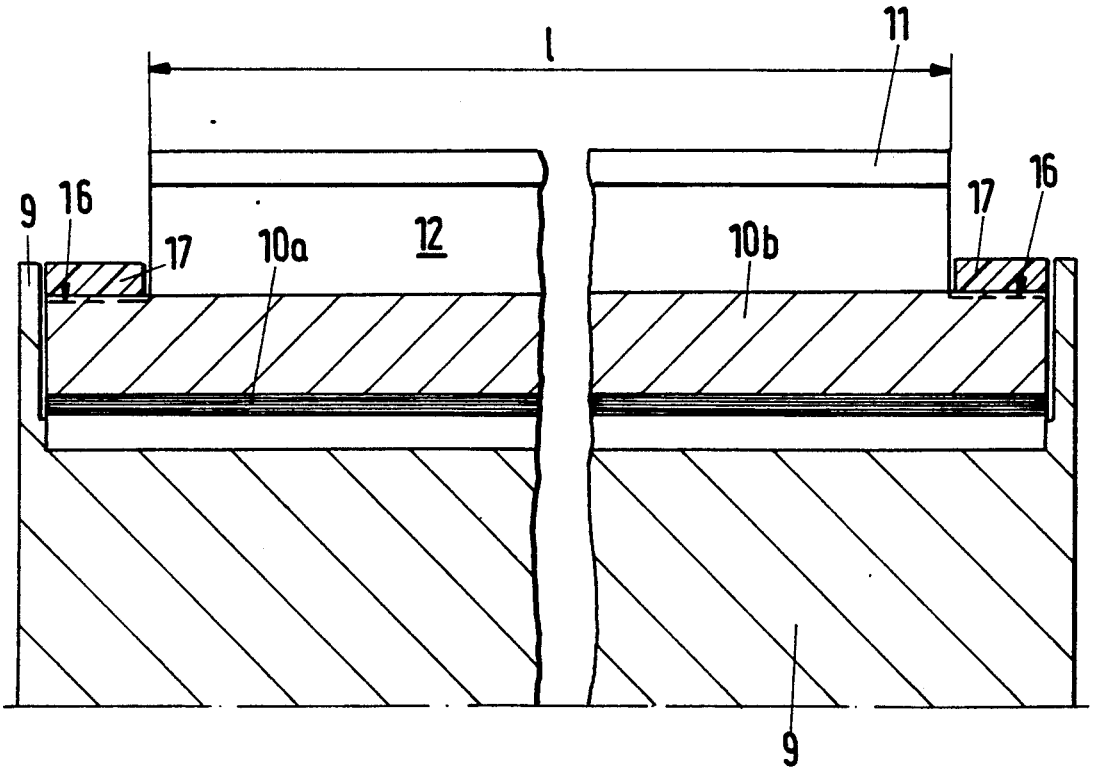
FIG. 4 is a cross-sectional view taken along the lines III/III of FIG. 3.

The design of the cutting belt 10 is evident from FIGS. 2–4. The cutting belt 10 is designed on its underside 10a as a toothed belt which has a thick reverse portion 10b provided with outwardly open slits into each of which there is pushed a cutter 12. Each cutter 12 has on each of both sides of its cutting edge 11, the length of which is indicated by 1, a stepped shoulder 16, over which in each case a tensioning band 17 is passed to bias the cutter toward the reverse portion 10b. The shoulders 16 lie approximately within the outer face of the reverse portion 10b.

What is claimed is:

1. A cutting machine for tuberiform vegetables and root crops, comprising:

a casing having an inner wall;

a rotor mounted for rotation in said casing, said rotor carrying material to be cut along with it in the direction of rotation of said rotor and at the same time pressing said material against the inner wall of the casing;

a flap pivotally mounted on said casing and partially defining the wall of the casing, said flap having a free end adjustable radially inwardly or outwardly;

a slice-cutting cutter mounted on said casing and having a cutting edge located adjacent the free end of said flap and defining therewith a cutting gap which defines the thickness of the cut;

adjusting means operatively engaging said flap for radially adjusting the position thereof so as to adjustably vary the thickness of the cut;

a strip cutter mounted on a driven cutting belt and provided with a plurality of spaced, transversely directed cutters adapted to engage the cut material downstream of said gap for cutting the material into strips; and a dice cutter mounted downstream of said strip cutter for cutting said strips transversely into dice;

wherein said strip cutter and said dice cutter are mounted on a common component bearer fixed exchangeably on said casing so as to form a compact cutting unit;

wherein said flap adjusting means is mounted on said component bearer;

wherein said slice-cutting cutter is mounted on said component bearer;

wherein the component bearer forming the cutting unit is mounted pivotally on said casing; and wherein said driven cutting belt is driven around upper and lower pulleys, a pivot axis of the component bearer being coaxial with the axis of the upper pulley.

2. The cutting machine as claimed in claim 1, further including interengageable guide means on said component bearer and said casing for ensuring a dimensionally accurate seating of said component bearer on said casing.

3. The cutting machine as claimed in claim 1, wherein a cutting zone defined by said transverse cutters of said strip cutter begins immediately after the cutting gap.

4. The cutting machine as claimed in claim 3, wherein said cutting belt forms an acute angle with the advancing direction of the slices of cut material leaving the cutting gap.

5. The cutting machine as claimed in claim 4, wherein, in the cutting zone, cutting edges of the transverse cutters of the cutting belt are at least approximately perpendicularly relative to the slice-cutting cutter which defines a flat cutting surface.

6. The cutting machine as claimed in claim 1, further including a supporting table mounted outwardly of a cutting zone, defined by said transverse cutters of said strip cutter, for supporting said cutting belt and absorbing the cutting forces.

7. The cutting machine as claimed in claim 1, wherein said cutting belt comprises on its underside a toothed belt, and further including toothed-belt pulleys around which said toothed belt engage for being driven.

8. A cutting machine for tuberiform vegetables and root crops, comprising:

a casing having an inner wall;

a rotor mounted for rotation in said casing, said rotor carrying material to be cut along with it in the direction of rotation of said rotor and at the same time pressing said material against the inner wall of the casing;

a flap pivotally mounted on said casing and partially defining the wall of the casing, said flap having a free end adjustable radially inwardly or outwardly;

a slice-cutting cutter mounted on said casing and having a cutting edge located adjacent the free end of said flap and defining therewith a cutting gap which defines the thickness of the cut;

adjusting means operatively engaging said flap for radially adjusting the position thereof so as to adjustably vary the thickness of the cut;

a strip cutter mounted on a driven cutting belt and provided with a plurality of spaced, transversely directed cutters adapted to engage the cut material downstream of said gap for cutting the material into strips; and a dice cutter mounted downstream of said strip cutter for cutting said strips transversely into dice;

wherein said strip cutter and said dice cutter are mounted on a common component bearer fixed exchangeably on said casing so as to form a compact cutting unit;

wherein said flap adjusting means is mounted on said component bearer;

wherein said slice-cutting cutter is mounted on said component bearer; and wherein said cutting belt has a thick reverse portion provided with outwardly open slits, into each of which there is pushed one of the transverse cutters of said strip cutter.

9. The cutting machine as claimed in claim 8, further including at least one tensioning band for holding said transverse cutters in said slits.

10. The cutting machine as claimed in claim 9, wherein each transverse cutter is formed with stepped shoulders on each side of a cutting edge defined by each of said transverse cutters, respectively, and with said at least one tensioning band engaging over each shoulder.

11. The cutting machine as claimed in claim 10, wherein said stepped shoulders lie approximately within an outer face of the reverse portion of said belt.

* * * * *